United States Patent [19]

Chang

[11] Patent Number: 4,491,762

[45] Date of Patent: Jan. 1, 1985

[54] FLAT STORAGE CRT AND PROJECTION DISPLAY

[75] Inventor: Ifay F. Chang, Chappaqua, N.Y.

[73] Assignee: International Business Machines Corporation, Armonk, N.Y.

[21] Appl. No.: 393,837

[22] Filed: Jun. 30, 1982

[51] Int. Cl.[3] ..... H01J 31/58

[52] U.S. Cl. ..... 313/392; 313/395; 313/397; 313/398

[58] Field of Search ..... 313/391, 392, 398, 395, 313/396, 397

[56] References Cited

U.S. PATENT DOCUMENTS

| | | | |
|---|---|---|---|
| 3,278,780 | 10/1966 | Carnahan et al. | 313/397 |
| 3,473,200 | 10/1969 | Hesse | 313/395 |
| 3,721,962 | 3/1973 | Foster et al. | 313/392 X |
| 3,805,126 | 4/1974 | Frobenius | 313/392 X |
| 4,262,230 | 4/1981 | Kato et al. | 313/395 |

FOREIGN PATENT DOCUMENTS

| | | | |
|---|---|---|---|
| 959576 | 12/1974 | Canada | 313/392 |

OTHER PUBLICATIONS

"Electron-Beam-Accessed Memory Has Potential for Cache Systems", Computer Design, Jul. 1975, vol. 14, No. 7, pp. 38–42.

*Primary Examiner*—David K. Moore
*Assistant Examiner*—Vincent DeLuca
*Attorney, Agent, or Firm*—George E. Clark

[57] ABSTRACT

A flat storage cathode ray tube with enhanced brightness is described. A mesh collector and a dielectric storage site array form an integral part of a silicon wafer. The silicon wafer includes thereon an addressable array of field effect transistors having a field effect transistor associated with a dielectric storage site in the storage site array for controlling a writing of the dielectric storage site. The addressable array of transistors works in cooperation with a flooding electron gun to effect selective writing of the storage site array. The enhanced brightness cathode ray tube may be adapted for use in a projection display.

7 Claims, 4 Drawing Figures

FLAT STORAGE CRT AND PROJECTION DISPLAY

DESCRIPTION

1. Technical Field

This invention relates generally to a storage cathode ray tube (CRT) display, and more particularly to a vacuum fluorescent display of the type suitable for both direct viewing and projection display.

2. Background Art

Mesh structured storage tubes are heretofore known. Storage in such tubes is achieved through the addition of a storage mesh in front of a fluorescent screen. A storage dielectric is placed on the storage mesh. The signals to be displayed are stored in the form of a charge pattern which exists on the surface of the dielectric as a result of being bombarded selectively by an electron beam. A flooding beam which serves as a second source of energy is modulated by the charge pattern on the storage mesh creating the stored image on the fluorescent viewing screen. However, such prior storage tubes are bulky, and are complicated to manufacture and complex circuitry is required to drive them.

Some prior CRTs provide storage effect by controlling the flow of electrons. As an example, in U.S. Pat. No. 3,087,087, issued to Joseph T. McNaney, a light responsive material is disposed on a perforated control grid for regulating the flow of electrons through the perforation. According to the patent, writing is accomplished by means of radiation selectively discharging a uniform charge. The selective radiation discharging means includes a phosphor and means causing an electron beam to impinge thereon whereby selected areas of the phosphor produce radiation.

Other prior storage CRTs provide a semiconductor target for the storage function. For instance, in U.S. Pat. No. 3,428,850 issued to M. H. Crowell, a storage CRT is described wherein the storage target structure comprises a semiconductive sheet upon which is defined an area of PNN+ semiconductor elements. The PNN+ is biased to be bistable. According to the patent, writing is by means of selectively scanning the target semiconductive sheet with an intensity modulated electron beam containing information to be recorded.

Another prior storage tube providing a semiconductor target for storage is described in U.S. Pat. No. 3,908,148 issued to N. B. Lehrer et al. An electro-optical transducer having a silicon layer, a silicon dioxide layer, a tantalum dioxide layer and aluminum elements is then employed as a storage target. According to the patent, the transducer structure forms an array of bistable semiconductor switches exhibiting diode-like characteristics, and capable of switching from one state to another in response to input signals. The bistable switches also provide high voltage switching capability for improved brightness.

Furthermore, U.S. Pat. No. 3,950,669 issued to E. M. Smith discloses a storage tube including a storage target. The storage target may include a substrate which may be an appropriately doped silicon wafer. The storage layer can be a secondary electron-emissive insulating compound of a semiconductor such as silicon dioxide. Between an electron gun and the silicon storage target there is disposed a secondary electron collector electrode which may be in the form of a mesh. According to the patent, writing is accomplished by using the electron gun. Moreover, U.S. Pat. No. 4,262,230 issued to Kato et al, describes a storage target for direct-view storage tubes wherein a collector mesh is integrally combined with the storage target. According to the patent, the storage target comprises a relatively rigid sheet of insulating material having a specific density coefficient, and a thin film electrode formed on one of the surfaces of the insulating material.

Some prior direct-view storage CRT provides a flat profile. As an example, U.S. Pat. No. 3,473,200 issued to K. R. Hesse discloses such a flat direct-view storage CRT. The disclosed storage tube includes a collector mesh positioned adjacent a storage target comprising a metallic storage mesh having a film of dielectric coating thereon. According to the patent, writing, reading and erasure are all accomplished by controlling an electron gun which is located at a neck section along the bottom of one edge of the flat screen.

More recently flat vacuum fluorescent displays have found applications in small alphanumeric displays, panel displays and even automobile dashboard displays. However, due to the lack of storage capability the picture elements of this type of CRT are multiplexed, thus, giving rise to a brightness less than desirable, especially in panels having a large number of picture elements. As a consequence, this type of display is limited both in resolution and size both of which are dictated by the CRT brightness.

Another prior flat CRT display is described in an article by W. C. Scott et al, entitled, "Flat Cathode-Ray-Tube Display", pp. 88–89, S. I. D. 78 Digest. According to the article, the disclosed flat CRT includes a phosphor coated faceplate, a digitally addressed multilayer switching stack which forms and controls multiple electron beams, and an area cathode assembly which generates a uniform flux of electrons directed toward the switching stack. This disclosed flat CRT has no storage capabilty.

DISCLOSURE OF INVENTION

It is a principal object of the present invention to provide a compact, flat profile vacuum fluorescent storage display.

It is also an object of this invention to provide an improved CRT with enhanced brightness.

It is another object of the present invention to provide a storage CRT which is inherently simpler to construct, and can be manufactured with substantially lower cost.

It is yet another object of the present invention to provide a storage CRT which can be adapted for projection display.

This and other objects of the present invention can be achieved by way of a storage CRT of the type wherein a mesh collector, and a dielectric storage site array are positioned between an area electron source and a phosphor screen, and wherein the improvement includes said mesh collector and said dielectric storage site array both being integral parts of a semiconductor wafer layer; said semiconductor wafer layer having thereon an addressable array of transistors, wherein a transistor is associated with a dielectric storage site in said storage site array for controlling a writing of said dielectric storage site; and said addressable array of transistors works in cooperation with said area electron source for selective writing of said storage site array.

The nature, principal and utility of the present invention will be better understood from the hereinafter detailed description of the invention, when read in conjunction with the accompanying drawings.

BRIEF DESCRIPTION OF THE DRAWINGS

The details of the invention will be described in connection with the accompanying drawings, in which.

BEST MODE FOR CARRYING OUT THE INVENTION

Figure 1:
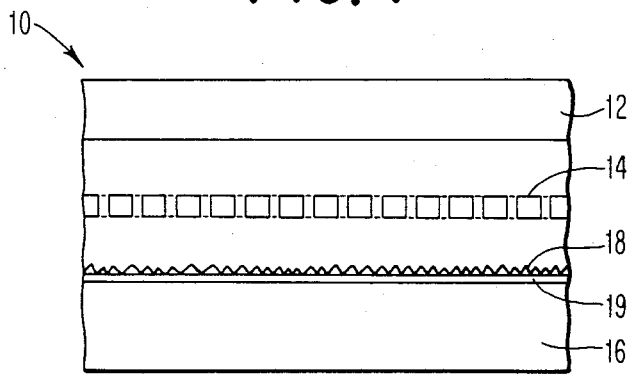
FIG. 1 is a simplified diagram of a compact flat profile direct viewing storage display according to the present invention.

As illustrated in FIG. 1, a preferred embodiment of a flat profile storage CRT 10 of the present invention includes an area electron source 12, and a silicon wafer layer 14 containing an integrated storage structure with an array of switching devices fabricated thereon. The silicon wafer 14 is disposed between the area electron source 12 and a viewing screen 16 which has deposited thereon a phosphor layer 18. The entire storage CRT 10 is housed in a vacuum envelope not shown.

The flat profile vacuum fluorescent CRT display 10 according to the present invention has storage capability (to be described hereinafter), and therefore, does not need refresh circuitry. Since the phosphor 18 operates under 100% duty cycle, a display with increased brightness is achieved. Since both the complex storage and writing function of the storage CRT 10 are achieved in an integrated monolithic structure in the form of a silicon wafer 14, the flat storage CRT 10, according to the present invention is inherently simpler to construct, and can be manufactured with substantially lower cost.

The area electron source 12 of FIG. 1 provides a uniform flooding electron beam having a diameter, for example, at about five inches or larger so as to substantially flood the entire area of the silicon wafer layer 14. The cathode (not shown) of the area electron source 12 may be connected to the ground potential. Flooding electron guns capable of providing the above described function are known heretofore. Typically, such an area cathode electron source may be made with tungsten coated with Sr-Ba oxide. For instance, U.S. Pat. No. 3,975,656, issued to Newton, et al, describes the use of such a flooding gun for providing a large area beam in a storage CRT read operation. Another area electron source is also described in the Scott article referred to hereinabove. As is described hereinafter, area electron source 12 works in conjunction with the silicon wafer layer 14 to perform both the write and read operations in the preferred embodiment of the present invention.

Figure 2:
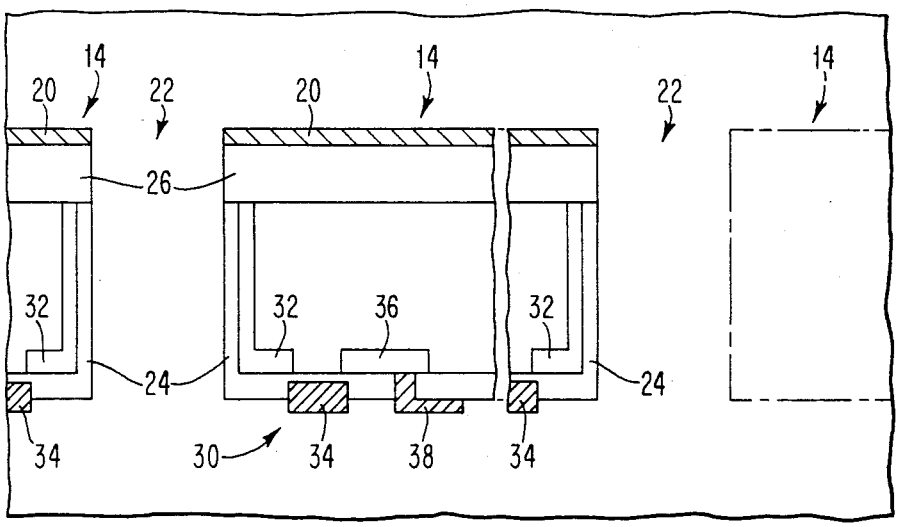
FIG. 2 shows an expanded cross sectional view of the silicon layer 14 showing in detail the construction of the storage site and the switching device for writing the storage site adjacent thereto.

Referring to FIG. 2, the integrated silicon wafer storage structure includes a metallic or polysilicon mesh collector 20 disposed on one surface of the silicon layer 14, and connected to a positive bias potential of about 50–150 volts, preferably at about 100 volts. A mesh array of through holes 22 in the silicon layer 14 form the storage sites for the CRT 10. Each mesh hole 22 is insulated from the mesh collector 20 by an insulation layer 26. The sidewalls of each mesh hole 22 is covered with a thin dielectric layer 24 such as $SiO_2$, MgO, MgF, or a combination thereof, as well as other suitable dielectric materials. The insulator 24 in each mesh hole 22 is each individually isolated from the rest of the mesh holes 22 in the array.

The mesh holes 22 in the silicon wafer layer 14 can be etched to appropriate dimensions to meet the resoution requirements in either direct viewing or in projection display. In a case of direct view display, it is preferable to have a 5–15 mils per diameter. This dimensional requirement is reduced by the projection magnification factor in a projection display. The mesh holes 22 array may be etched using several known anisotropic etching techniques. One such technique, for instance, is described in the IBM Technical Disclosure Bulletin, Vol. 24, No. 10, March 1982, pp. 4972–4973, for making thin film screens for display applications.

Each mesh hole 22 constitutes, as will be described hereinafter, a storage site for controlling the luminescence of a picture element on the viewing screen 16. The storage function, as will be described hereinafter, is substantially accomplished by way of a secondary electron emission effect at the surface of the dielectric layer 24 in mesh hole 22.

Associated with each mesh through hole 22 is an FET switching device 30, having a source region 32, a gate 34 and a drain region 36. The source region 32 of FET switching device 30 is disposed on a second surface of the silicon wafer layer 14, and adjacent to the dielectric layer 24 in the mesh hole 22. To effectively control the electric field inside mesh hole 22, device 30 may have a circular configuration, and may completely surround mesh hole 22. Source diffusion region 32 of FET switching device 30 may be extended along the through hole 22 region, and may substantially surround the thin dielectric layer 24 to assure effective charging of the dielectric layer 24 surface by both collecting electrons from area source 12, and emitting electrons by way of secondary electron emissions. As will be described hereinafter, by selecting the associated FET switching device 30 and applying a potential to its gate 34, a particular mesh hole dielectric layer 24 may be charged to a desired potential by way of secondary electron emissions at the surface of the dielectric layer 24, depending on the potential initially set at the source 32 of FET 30.

Selection of a particular mesh hole 22 storage site, or a line of such mesh hole 22 storage sites for a write operation can be effected by conventional digital logic matrix addressing schemes, commonly employed in random access memory array. The array of FET switching devices 30 on the second surface of the silicon wafer layer 14 can be fabricated using conventional MOS technology, both the metal gate and the polysilicon gate types are known, and are practiced and described profusely by one of ordinary skill in the art of MOS/LSI technology, for instance, see "Integrated Circuits Design Principles and Fabrication", R. M. Warner, Jr., Editor, McGraw-Hill, New York 1965, for more details.

While a silicon wafer layer 14 and an array of field effect transistors (FETs) 30 are employed in the above-described preferred embodiment, it is clear to one of ordinary skill in this art that other suitably doped semiconductor layers and other switching transistors, such as bipolar transistors, may be substituted instead without departing from the general teachings of the present invention. Furthermore, it is clear that silicon wafer layer 14 may include thereon other peripheral circuits and logic circuits necessary or useful for an improved CRT 10.

Assume a bulk erasure (more to be described hereinafter) of storage CRT 10 is effected. To perform a write operation, by way of connecting electrode 38, a positive potential of about 5–10 volts is applied to the drain 36 of the selected FET 30 so as to write a "0". A selected FET 30 here and hereinafter denotes an FET which has been turned on by a select potential provided by the matrix addressing scheme. A "0" here and hereinafter refers to a picture element with no light emission, while a "1" denotes a bright picture element. The source 32 is charged to about 5–10 volts by a sample and hold action by switching FET 30 on momentarily and then off while the area electron source 12 continuously floods the silicon wafer layer 14 with electrons. Some of these electrons emitted from the area electron source 12 land on the dielectric layer 24 creating secondary electron emissions. With the source 32 at about 5–10 volts, the secondary electron emission ratio at the surface of the dielectric layer 24 is less than unity. Under this condition, the dielectric layer 24 absorbs the emitted electron from the area electron source 12 as well as any secondary electrons emitted therefrom.

As a result of collecting these additional electrons emitted from the area electron source 12, the potential at the surface of the dielectric layer 24 will be charged negatively and a "0" is written on dielectric layer 24 in the selected mesh hole 22 storage site. This negative potential will pinch off electrons emitted from the area electron source 12 from going through the mesh hole 22 resulting that no electrons will strike the phosphor layer 18 at a corresponding area immediately below the selected mesh hole 22.

To write a "1", a positive potential of about 40–150, preferably about 100 volts is applied to the drain 36 of the selected FET 30. Similarly, the source 32 is charged to about 40–150 volts by a sample and hold action by switching FET 30 momentarily on and then off. In this case, with the source 32 at about 40–150 volts, the secondary electron emission ratio at the surface of the dielectric layer 24 is greater than unity. Under these conditions, some of the secondary electrons emitted from the dielectric layer 24 as a result of bombardments by electrons emitted from the area electron source 12, will be collected by mesh collector 20, and giving rise to a net loss of electrons at the surface of dielectric layer 24. As a result, the potential at the surface of the dielectric layer 24 will be charged positively up close to the collector 20 potential, and a "1" is written into the selected mesh hole 22. This positive potential at selected mesh hole 22 will permit the passage of electrons emitted from area electron source 12 to go through the selected mesh hole 22. These electrons are then accelerated towards the phosphor layer 18 thereby creating a bright picture element at an area immediately below the selected mesh hole 22 provided the phosphor layer 18 is biased at a high positive potential by the transparent anode electrode 19.

With the surface leakage to the mesh collector 20 under proper control, there is no leakage current path. Once a "1" or "0" is written on the dielectric layer 32, the information will be retained with a long retention time. Accordingly, the CRT 10 according to the present invention has storage effect.

Reading of the recording information is accomplished by flooding the silicon wafer layer 14 with electrons emitted from the area electron source 12. As these electrons approach the silicon wafer layer 14 vicinity, they will be pinched off and stopped by those mesh holes 22 containing a recorded "0". In those selected mesh holes 22 recorded with a "1" electrons will be pulled through by the high electric field created by a high voltage, which can be from about 100 to 30,000 volts, applied to the phosphor layer 18 by way of the transparent anode electrode 19. Those electrons able to pass through will strike the phosphor layer 18 with high velocity causing a pattern of luminance on the screen 16 corresponding to the pattern information stored earlier in the array of storage sites in the silicon wafer layer 14.

Erasure of recorded information can be either "bulk" or "selective". In the bulk erasure mode, the filament potential can be dropped to 50–150 volts below the former cathode potential which is at ground, for a short duration. During this short duration, the secondary electron emission ratio, with the surface of the dielectric layer 24 being at essentially 50–150 volts, is greater than 1. In this case, every dielectric layer 24 in every mesh hole 22 will be charged positively, and electrons from the area electrons source 12 will be allowed to pass through to strike phosphor layer 18 creating a display with every picture element giving luminance.

Alternatively, a 40–150 volt potential can be applied to all drains 36 in the FET array to perform a write "1" operation, thus, turning on every pel. If the applied potential to the drains 36 is dropped to a low voltage, all the storage sites 22 will be charged negatively to pinch off the electrons, and to prevent them from passing through. Another method of bulk erasure would be simply dropping the collector 20 potential to the cathode potential causing all storage sites 22 to be charged to the cathode potential, thus pinching off the passage of electrons.

To achieve selective erasure, the mesh collector 20 may be partitioned into groups of lines orthogonal to groups of lines connecting the gates 34. To selectively erase one picture element at position (X,Y) in the array of transistors 30, the potential of the collector 20 line (Y) is lowered, the select gate potential applied to the gate 34 line (X) is raised to turn on the selected FET 30, and a low potential is applied to the drain 36, all in a short duration to effect erasure of the picture element at position (X,Y) while not disturbing the remaining picture elements.

Figure 3:
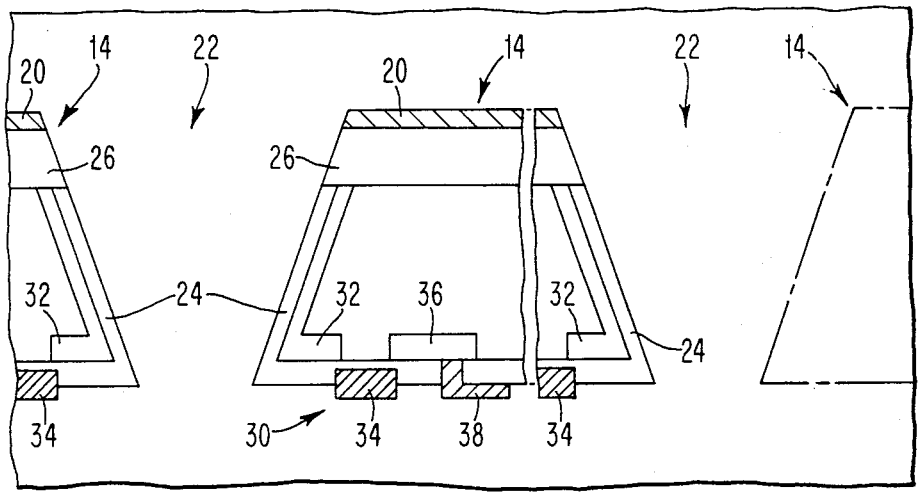
FIG. 3 shows an alternative embodiment of the storage site shown in FIG. 2.

While the cross sectional view of the mesh hole 22 storage site in FIG. 2 is shown and described in the specification as a rectangular through hole, it is clear that mesh hole 22 of direct viewing storage CRT 10 can take on different shapes and configurations. For instance, a second embodiment of the mesh hole 22 storage site according to the teaching of the present invention is shown in FIG. 3. Instead of a rectangular cross sectional shape, the second preferred embodiment according to the present invention shows in FIG. 3 a mesh hole 22 with a funnel shape cross section, and with the larger opening of said funnel through hole 22 facing the electrons emitted from the area electron source 12.

Comparing with the embodiment shown in FIG. 2, the mesh hole 22 with a funnel cross section may allow a larger number of electrons from area source 12 to land on dielectric layer 24. As a result of greater number of electrons collected at the dielectric 24 surface, such a funnel shape storage site may have a faster dielectric layer 24 charge up time, and therefore, a higher CRT 10 writing speed. Furthermore, in view of the concentration of the incoming electrons made possible by this funnel configuration, further enhanced brightness may also be achieved in a storage CRT 10 incorporating a mesh hole 22 storage site of this configuration.

The array of through holes 22 may be arranged in a rectangular form with equal or different pitch in two orthognal directions. To avoid aliasing and other unwanted effects, the array of through holes 22 may be arranged in a closely packed hexagonal pattern or such patterns as used in conventional shadow mask CRTs.

Figure 4:
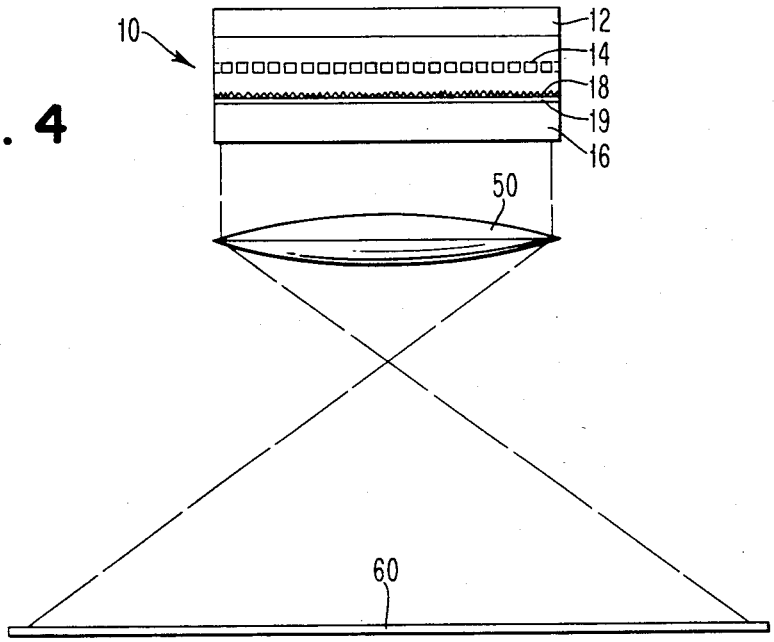
FIG. 4 shows the storage CRT of FIG. 1 adapted for use in a projection display.

Although the storage CRT 10 in FIGS. 1, 2 and 3 is shown and described for direct viewing configuration, the teaching of the present invention may be adapted also in a projection display. Referring to FIG. 4, the image of the storage CRT 10 is magnified by lens 50 and is then projected onto screen 60 for enlarged viewing. As described hereinabove, CRT 10 provides storage effect with 100% phosphor duty cycle to effect enhanced brightness. This brightness improvement is particularly important and beneficial in a projection display of the type shown in FIG. 4. Also, since storage CRT 10 is compact and has a flat profile, the projection display according to the teachings of the present invention retains this flat profile advantage.

The present flat storage CRT invention according to the teachings hereinabove may be especially beneficial for multifunction display applications in the automobile industry, in display terminals, and as a control panel on advanced instruments and office machines.

While only a single bit of information is shown and described to be stored in dielectric storage site 22, the present embodiments may be extended to include gray scale and color features. For instance, it certainly is possible to make a color display of this type, by providing a set of three storage channels for each picture element, and using a color phosphor faceplate. The gray scale may be achieved if CRT bistability is given up for a variable charge storage, which will then allow variable amount of electrons to pass through, thus giving variables brightness.

Although the yield of such a large array of FETs 30 is always a concern, it is clear that the teachings of the present invention are not limited to a single FET associated with a through hole 22 storage site in the storage array. More specifically, conventional redundancy techniques may be utilized to enhance the overall yield in the large array of FETs 30.

From the preceding detailed description of applicant's invention, it is seen that both storage CRT, and a projection display constructed according to the teachings of the present invention have advantages heretofore not possible to achieve. In addition to the variations and modifications of applicant's disclosed preferred embodiments which have been suggested, many other variations and modifications will be apparent to those skilled in this art, and accordingly the scope of applicant's invention is not construed to be limited to the particular embodiment shown or suggested.

Having thus described my invention, what I claim as new, and desire to secure by Letters Patent is:

1. In a storage cathode ray tube of the type wherein a mesh collector, and a dielectric storage site array are positioned between an area electron source and a phosphor screen, the improvement comprising:

a semiconductor wafer having a first integral layer comprising said mesh collector, and wherein said dielectric storage site array comprises;

a through hole in said semiconductor wafer;

a layer of dielectric material on sidewalls of said through hole for charge storage by collecting electrons from an area electron source, and emitting electrons by way of secondary electron emission;

said semiconductor wafer having thereon an addressable array of transistors for controlling the passage of electrons from said area electron source to said dielectric storage site array;

said addressable array of transistors selecting a predetermined site in said storage site array for writing by electrons from said area electron source;

a source of an associated transistor being disposed along said sidewalls of said through hole, and subsequently surrounding said layer of dielectric material; and stored charge on a surface of said dielectric layer in said storage site depending upon a potential set at said source.

2. A storage cathode ray tube as set forth in claim 1, wherein said area electron source is a flooding electron gun for reading the stored content of said storage site array and for writing a predetermined site in said storage site array under the control of said addressable array of transistors.

3. In a storage cathode ray tube as set forth in claim 2 wherein said semiconductor wafer layer is a silicon wafer.

4. In a storage cathode ray tube as set forth in claim 3 wherein said transistors are field effect transistors.

5. In a storage cathode ray tube as set forth in claim 1 wherein said through hole has a funnel shape cross section with the larger opening of said funnel shape through hole facing the electrons emitted from said flooding electron gun, and wherein said storage cathode ray tube has a flat profile.

6. A storage cathode ray tube as set forth in claim 1 wherein said area electron source is an array of heated tungsten filaments.

7. In a projeotion display of a type wherein an image on a CRT is magnified by a lens, and is projected onto a viewing screen, the improvement including a storage cathode ray tube as set forth in claim 1.

* * * * *